US010502386B2

(12) United States Patent
Nishimura et al.

(10) Patent No.: US 10,502,386 B2
(45) Date of Patent: Dec. 10, 2019

(54) VEHICLE LAMP

(71) Applicant: STANLEY ELECTRIC CO., LTD., Tokyo (JP)

(72) Inventors: Shota Nishimura, Tokyo (JP); Kazuma Kamioka, Tokyo (JP)

(73) Assignee: STANLEY ELECTRIC CO., LTD., Tokyo (JP)

( * ) Notice: Subject to any disclaimer, the term of this patent is extended or adjusted under 35 U.S.C. 154(b) by 0 days.

(21) Appl. No.: 16/270,403

(22) Filed: Feb. 7, 2019

(65) Prior Publication Data

US 2019/0242545 A1 Aug. 8, 2019

(30) Foreign Application Priority Data

Feb. 8, 2018 (JP) ..... 2018-020840

(51) Int. Cl.

| | |
|---|---|
| ***F21S 41/68*** | (2018.01) |
| ***F21S 41/32*** | (2018.01) |
| ***F21S 41/43*** | (2018.01) |
| ***F21S 41/25*** | (2018.01) |

(52) U.S. Cl.

CPC ..... *F21S 41/68* (2018.01); *F21S 41/25* (2018.01); *F21S 41/32* (2018.01); *F21S 41/43* (2018.01)

(58) Field of Classification Search

CPC .. F21S 41/25; F21S 41/32; F21S 41/43; F21S 41/68

See application file for complete search history.

(56) References Cited

U.S. PATENT DOCUMENTS

2011/0122637 A1* 5/2011 Futami ..... F21S 41/147 362/519
2016/0102831 A1* 4/2016 Okubo ..... F21S 41/19 362/512
2017/0211771 A1 7/2017 Nishimura et al.

FOREIGN PATENT DOCUMENTS

WO 2015/178155 A1 11/2015

* cited by examiner

*Primary Examiner* — Thomas M Sember
(74) *Attorney, Agent, or Firm* — Kenealy Vaidya LLP

(57) ABSTRACT

A vehicle lamp comprising: a front lens body; a rear lens unit disposed behind the front lens body; and a light source that emits light to be irradiated forward after passing through the rear lens unit and the front lens body to form a low-beam light distribution pattern, wherein the rear lens unit includes an edge section that defines a cutoff line, and a reflection surface, the reflection surface internally reflects the light from the light source, the edge section includes a first edge part, a second edge part, and a third edge part connecting between the first edge part and the second edge part, the reflection surface includes a first reflection surface including the first edge part, a second reflection surface including the second edge part, and a third reflection surface including the third edge part, and the third reflection surface is inclined with respect to a reference axis.

9 Claims, 8 Drawing Sheets

VEHICLE LAMP

CROSS-REFERENCE TO RELATED APPLICATION

This application is based upon and claims the benefit of priority of the prior Japanese Patent Application No. 2018-020840, filed on Feb. 8, 2018 the entire contents of which are incorporated herein by reference.

FIELD

The present invention relates to a vehicle lamp, and more particularly to a vehicle lamp that can reduce the occurrence of glare in the vicinity of an oblique cutoff line of a low-beam light distribution pattern.

BACKGROUND

FIG. 8A is a top view showing a conventional vehicle lamp 100 (those other than major optical surfaces are omitted); FIG. 8B is a cross-sectional view taken along line A-A in FIG. 8A (those other than the major optical surfaces are omitted); and FIG. 8C is a cross-sectional view taken along line B-B in FIG. 8A (those other than the major optical surfaces are omitted).

As shown in FIG. 8A, there has been conventionally known the vehicle lamp 100 (see FIG. 32, etc. of Patent Literature 1, for example) including: a front lens body 101; a rear lens unit 102 disposed behind the front lens body 101; and a light source 103 that is disposed behind the rear lens unit 102 and emits light to be irradiated forward after passing through the rear lens unit 102 and the front lens body 101 in this order so as to form a low-beam light distribution pattern (see FIG. 9). The rear lens unit 102 is a lens unit that serves to condense light in a first direction (e.g., an up-and-down direction in FIG. 8A), and the front lens body 101 is a lens unit that serves to condense light in a second direction orthogonal to the first direction (e.g., a direction orthogonal to the plane of the paper in FIG. 8A).

The rear lens unit 102 includes: a first light-entering surface 102*a*; a first light-exiting surface 102*b* opposite to the first light-entering surface 102*a*; an edge section 102*c* provided between the first light-entering surface 102*a* and the first light-exiting surface 102*b* (focal point F); and a reflection surface 102*d* extending rearward from the edge section 102*c*.

The edge section 102*c* includes: a first edge part e1*a* corresponding to a left cutoff line CL1*a*; a second edge part e2*a* corresponding to a right cutoff line CL2*a*; and a third edge part e3*a* corresponding to an oblique cutoff line CL3*a* connecting between the left cutoff line CL1*a* and the right cutoff line CL2*a*.

The reflection surface 102*d* includes: a first reflection surface r1*a* including the first edge part e1*a*; a second reflection surface r2*a* including the second edge part e2*a*; and a third reflection surface r3*a* including the third edge part e3*a*.

The third reflection surface r3*a* extends rearward from the third edge part e3*a* along a reference axis $AX_{Lo}$ extending in a vehicle longitudinal direction. That is, the third reflection surface r3*a* is a surface parallel to the reference axis $AX_{Lo}$.

The front lens body 101 includes: a second light-entering surface 101*a*; and a second light-exiting surface 101*b* opposite to the second light-entering surface 101*a*.

When the light source 103 is turned on in the vehicle lamp 100 with the above-described configuration, light from the light source 103 enters the rear lens unit 102 through the first light-entering surface 102*a*, and exits, after being partially blocked by the reflection surface 102*d*, through the first light-exiting surface 102*b* together with reflected light from the reflection surface 102*d*. Then, the light from the light source 103 that exits through the first light-exiting surface 102*b* is condensed in the first direction due to the function of the first light-exiting surface 102*b*. The light from the light source 103 that has exited through the first light-exiting surface 102*b* then passes through a space Sa between the rear lens unit 102 and the front lens body 101, further enters the front lens body 101 through the second light-entering surface 101*a*, and exits through the second light-exiting surface 101*b* to be irradiated forward. Then, the light from the light source 103 that exits through the second light-exiting surface 101*b* is condensed in the second direction due to the function of the second light-exiting surface 101*b*. This forms the low-beam light distribution pattern.

Patent Literature 1: WO2015/178155

SUMMARY

Simulation verification conducted by the present inventors, however, has showed that glare (see an area surrounded by a square Ga in FIG. 9) occurs in the vicinity of the oblique cutoff line CL3*a* of the low-beam light distribution pattern formed on a virtual vertical screen as shown in FIG. 9 due to light RayB (see FIG. 8C) from the light source 103 that has been reflected by the third reflection surface r3*a* and passed through the B-B cross-section in the vehicle lamp 100 with the above-described configuration. FIG. 9 is a partial enlarged view (simulation result) of the low-beam light distribution pattern formed by the vehicle lamp 100 in the vicinity of the oblique cutoff line CL3*a*.

The reason why glare occurs in the vicinity of the oblique cutoff line CL3*a* is because a distance SA (see FIG. 8B) between the first light-exiting surface 102*b* and the second light-entering surface 101*a* in the A-A cross-section is different from a distance SB (see FIG. 8C) between the first light-exiting surface 102*b* and the second light-entering surface 101*a* in the B-B cross-section, resulting in a significant displacement between a focus position (light condensing position) FA (see FIG. 8B) in the A-A cross-section and a focus position (light condensing position) FB (see FIG. 8C) in the B-B cross-section (especially when the front lens body 101 is disposed in an inclined manner at a sweepback angle θ1 with respect to a reference axis AX1 extending in a vehicle width direction as shown in FIG. 8A).

The present invention has been made in view of the aforementioned circumstances, and an object of the present invention is to provide a vehicle lamp that can reduce the occurrence of glare in the vicinity of an oblique cutoff line of a low-beam light distribution pattern.

In order to achieve the object described above, an aspect of the present invention is a vehicle lamp comprising:

a front lens body;

a rear lens unit disposed behind the front lens body; and a light source disposed behind the rear lens unit, the light source emitting light to be irradiated forward after passing through the rear lens unit and the front lens body in this order so as to form a low-beam light distribution pattern, wherein the rear lens unit includes an edge section that defines a cutoff line of the low-beam light distribution pattern, and a reflection surface provided between the edge section and a rear end of the rear lens unit, the reflection surface internally reflects at least part of the light from the light source that has entered the rear lens unit, the edge section includes a first edge part corresponding to a left cutoff line, a second edge part corresponding to a right cutoff line, and a third edge part corresponding to an oblique cutoff line connecting between the left cutoff line and the right cutoff line, the reflection surface includes a first reflection surface including the first edge part, a second reflection surface including the second edge part, and a third reflection surface including the third edge part, and the third reflection surface is inclined with respect to a reference axis extending in a vehicle longitudinal direction.

According to this aspect, there can be provided the vehicle lamp that can reduce the occurrence of glare in the vicinity of the oblique cutoff line of the low-beam light distribution pattern.

This is achieved by the third reflection surface being inclined with respect to the reference axis extending in the vehicle longitudinal direction.

A preferred mode in the above-described invention is characterized in that the third reflection surface is inclined with respect to the reference axis so that the light from the light source that has been internally reflected by the third reflection surface travels in a direction other than to a light-exiting surface of the rear lens unit.

A preferred mode in the above-described invention is characterized in that the rear lens unit includes a light-exiting surface through which the light from the light source that has been internally reflected by the third reflection surface exits.

A preferred mode in the above-described invention is characterized in that the rear lens unit includes an additional reflection surface that internally reflects the light from the light source that has been internally reflected by the third reflection surface, and the additional reflection surface is configured as a reflection surface that internally reflects the light from the light source that has been internally reflected by the third reflection surface in a direction such that the light from the light source that has been internally reflected by the third reflection surface is internally reflected once or a plurality of times by the light-exiting surface of the rear lens unit.

A preferred mode in the above-described invention is characterized in that the rear lens unit includes a light-blocking part that blocks the light from the light source that has been internally reflected by the third reflection surface.

A preferred mode in the above-described invention is characterized in that the third reflection surface is inclined with respect to the reference axis so that the light from the light source that has been internally reflected by the third reflection surface travels in a direction other than to the low-beam light distribution pattern.

A preferred mode in the above-described invention is characterized in that the rear lens unit is a lens unit that condenses the light from the light source that passes through the rear lens unit in a first direction, the front lens body is a lens unit that condenses the light from the rear lens unit that passes through the front lens body in a second direction orthogonal to the first direction, and at least one of a light-entering surface and a light-exiting surface of the front lens body is a cylindrical surface extending in the first direction.

DESCRIPTION OF EMBODIMENTS

Figure 1:
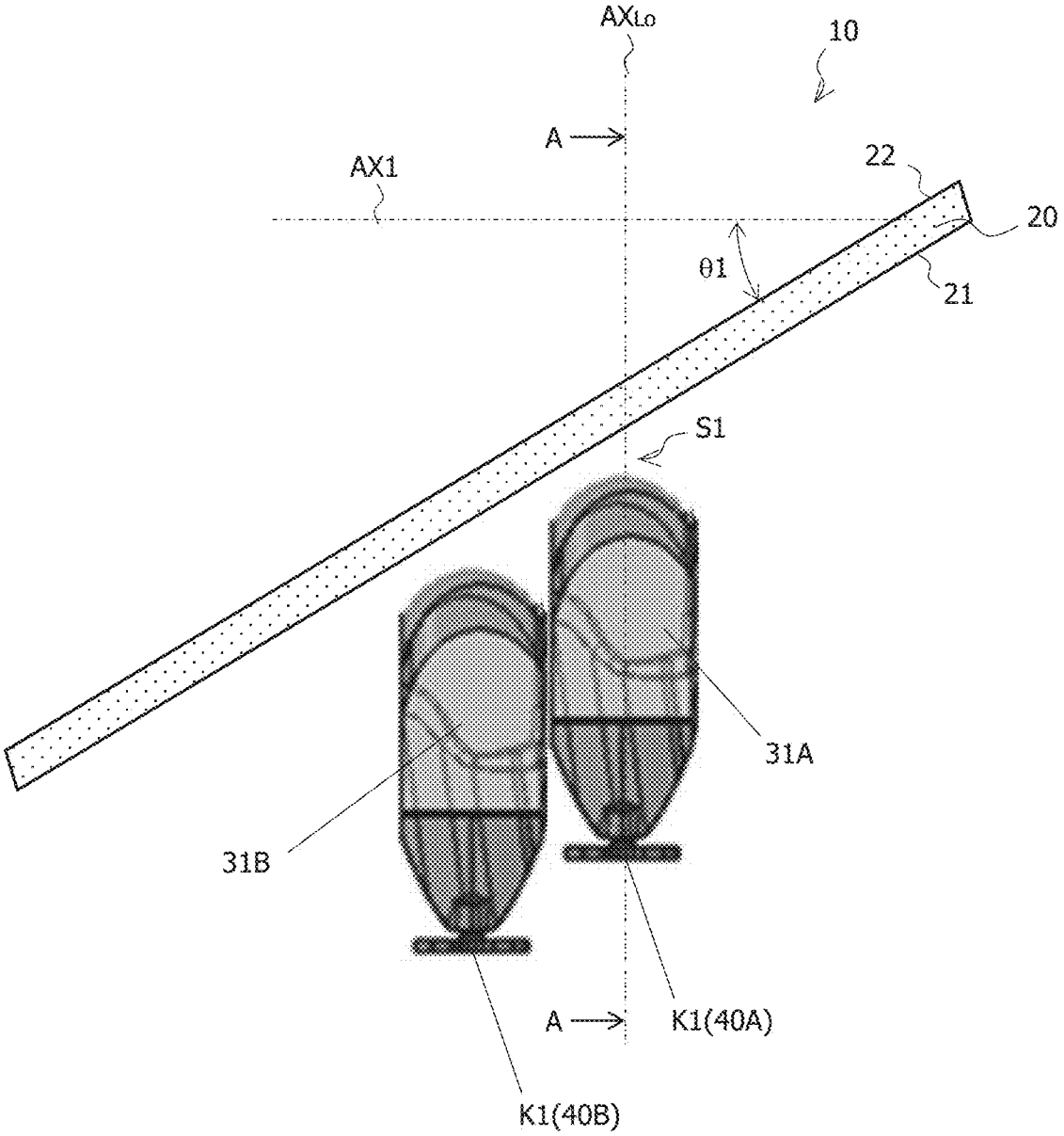
FIG. 1 is a top view of the vehicle lamp 10.

Hereinafter, a vehicle lamp 10 that is an embodiment of the present invention will be described with reference to the accompanying drawings. Equivalent components in the figures are denoted by the same reference numerals, and overlapping description will be omitted.

Figure 2:
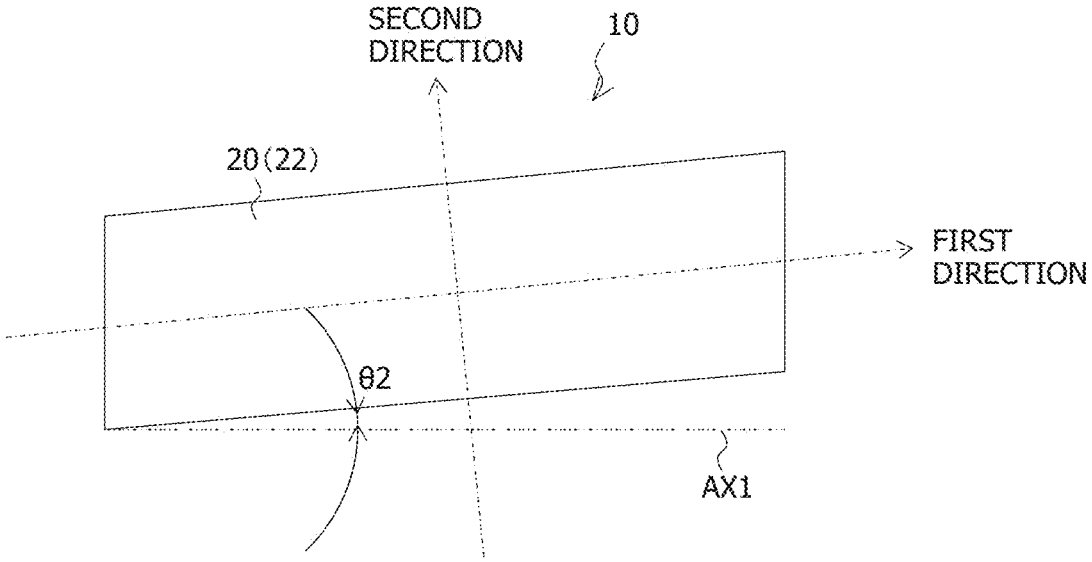
FIG. 2 is a front view of the vehicle lamp 10.

FIG. 1 is a top view of the vehicle lamp 10. FIG. 2 is a front view of the vehicle lamp 10.

The vehicle lamp 10 shown in FIGS. 1 and 2 is a vehicle headlight (headlamp) and installed on either side of a front end of a vehicle such as an automobile, for example. Since the vehicle lamps 10 installed on both sides have a symmetrical configuration, the vehicle lamp 10 installed on the left side of the front end of the vehicle (on the observer's left when looking ahead of the vehicle) will be described hereinafter as a representative. The vehicle lamp 10 is disposed in a lamp chamber composed of an outer lens and a housing, which are not shown in the figures, and attached to the housing, for example.

Figure 3:
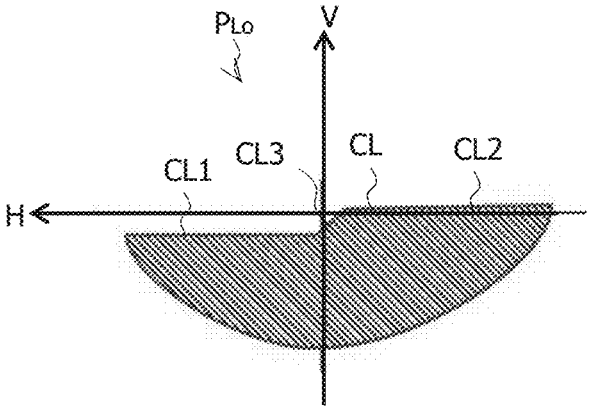
FIG. 3 is an example of a low-beam light distribution pattern PLo formed by the vehicle lamp 10.

FIG. 3 shows an example of a low-beam light distribution pattern $P_{Lo}$ formed by the vehicle lamp 10. FIG. 3 shows an example of the low-beam light distribution pattern $P_{Lo}$ formed on a virtual vertical screen (disposed about 25 meters forward of the vehicle front) directly facing the vehicle front (in the case of the right-hand traffic). The low-beam light distribution pattern $P_{Lo}$ includes a cutoff line CL at an upper edge thereof. The cutoff line CL includes: a left cutoff line CL1; a right cutoff line CL2; and an oblique cutoff line CL3 connecting between the left cutoff line CL1 and the right cutoff line CL2. The oblique cutoff line CL3 is inclined at an angle of 45° with respect to a horizontal line H. Note that the oblique cutoff line CL3 may be inclined at an angle of 15° with respect to the horizontal line H.

As shown in FIG. 1, the vehicle lamp 10 includes: a front lens body 20 extending in a predetermined direction; a plurality of rear lens units 31A to 31B disposed behind the front lens body 20 along the predetermined direction; and a plurality of light sources 40A to 40B disposed behind the plurality of rear lens units 31A to 31B. The light sources 40A to 40B emit light to be irradiated forward after passing through the rear lens units 31A to 31B and the front lens body 20 in this order so as to form the low-beam light distribution pattern $P_{Lo}$.

The rear lens units 31A to 31B each have the same configuration and the light sources 40A to 40B each have the same configuration. Thus, the rear lens units 31A to 31B and the light sources 40A to 40B are referred to as a rear lens unit 31 and a light source 40, respectively, when their discrimination is not necessarily required.

The front lens body 20 is a lens unit extending in the predetermined direction (hereinafter, referred to also as a first direction). The front lens body 20 mainly serves to condense light from the rear lens unit 31 that passes through the front lens body 20 in a second direction orthogonal to the first direction.

The front lens body 20 is made of a transparent resin such as an acrylic or polycarbonate resin, and molded by injection molding. The predetermined direction is, for example, a direction inclined, as viewed from the top, at a sweepback angle θ1 with respect to a reference axis AX1 extending in a vehicle width direction as shown in FIG. 1 and also inclined, as viewed from the front, at an upward-slanting angle θ2 with respect to the reference axis AX1 extending in the vehicle width direction as shown in FIG. 2. Each of the angles θ1 and θ2 is any angle in a range of 0 to 90 degrees.

As shown in FIG. 1, the front lens body 20 includes: a second light-entering surface 21 extending in the first direction; and a second light-exiting surface 22 disposed opposite to the second light-entering surface 21 and extending in the first direction.

The second light-entering surface 21 is, for example, a flat surface (e.g., a vertical surface). In order to condense light from the rear lens unit 31 that exits through the second light-exiting surface 22 in the second direction orthogonal to the first direction, the second light-exiting surface 22 is configured as a semi-cylindrical surface (cylindrical surface) with a cylindrical axis thereof extending in the first direction (linearly).

Figure 4:
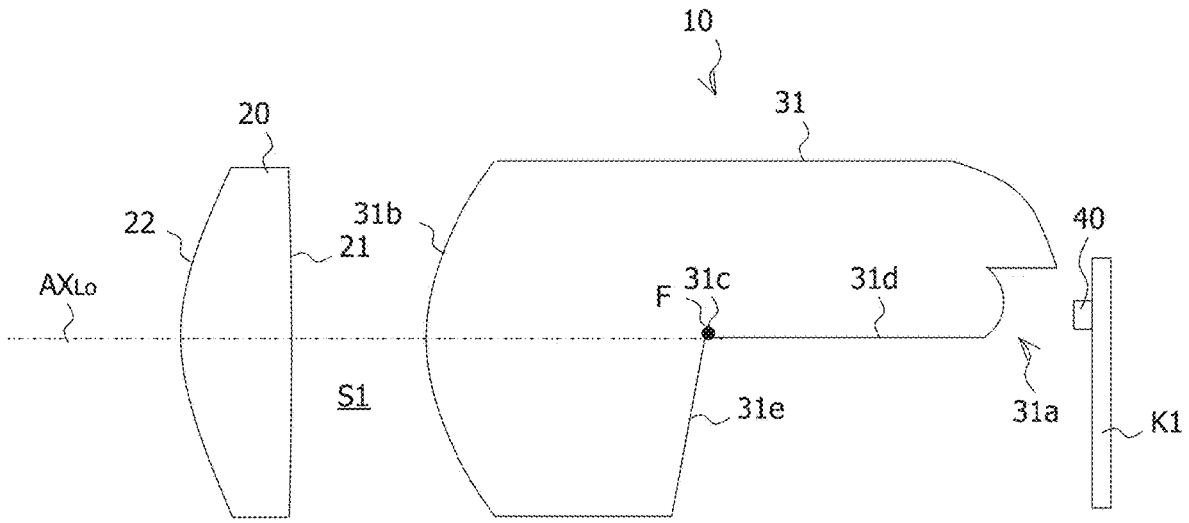
FIG. 4 is a cross-sectional view of the vehicle lamp 10 shown in FIG. 1 taken along line A-A.

FIG. 4 is a cross-sectional view of the vehicle lamp 10 shown in FIG. 1 taken along line A-A.

As shown in FIG. 4, the front lens body 20, the rear lens unit 31, and the light source 40 together form a low-beam optical system.

Whereas a single projection lens serves to condense light in the first direction and light in the second direction orthogonal to the first direction in common vehicle lamps, the two lenses (the front lens body 20 and the rear lens unit 31) that constitute a projection lens serve to condense light in the first direction and light in the second direction orthogonal to the first direction in this embodiment. More specifically, the rear lens unit 31 mainly serves to condense light in the first direction and the front lens body 20 mainly serves to condense light in the second direction in this embodiment.

The light source 40 is a semiconductor light-emitting element such as an LED or an LD, including a rectangular (1 mm square, for example) light-emitting surface. The light source 40 is mounted on a substrate K1 with the light-emitting surface facing forward (the front). The substrate K1 is attached to a housing (not shown), for example, by means of screw clamping, for example.

The rear lens unit 31 includes: a first light-entering surface 31*a*; a first light-exiting surface 31*b* opposite to the first light-entering surface 31*a*; an edge section 31*c* provided between the first light-entering surface 31*a* and the first light-exiting surface 31*b* (focal point F); a reflection surface 31*d* extending rearward from the edge section 31*c*; and an extended surface 31*e* extending downward from the edge section 31*c*. The rear lens unit 31 mainly serves to condense light from the light source 40 that passes through the rear lens unit 31 in the first direction. The rear lens unit 31 is made of a transparent resin such as an acrylic or polycarbonate resin, and molded by injection molding.

The light from the light source 40 that has entered the rear lens unit 31 through the first light-entering surface 31*a* is condensed toward the edge section 31*c* for at least the vertical direction (the up-and-down direction in FIG. 4). This makes the low-beam light distribution pattern $P_{Lo}$ relatively brighter in the vicinity of the cutoff line.

In order to condense light from the light source 40 that exits through the first light-exiting surface 31*b* in the first direction, the first light-exiting surface 31*b* is configured as a semi-cylindrical surface (cylindrical surface) with a cylindrical axis thereof extending in the second direction, for example.

Figure 5A:
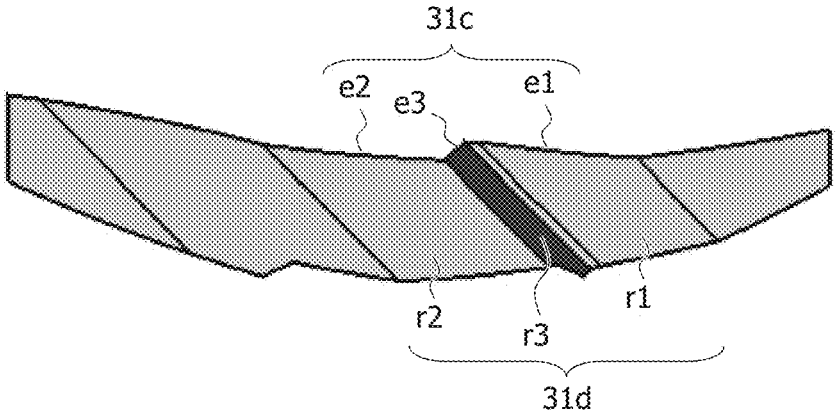
FIG. 5A is a partial enlarged perspective view of the edge section 31*c* and the reflection surface 31*d*.
Figure 5B:
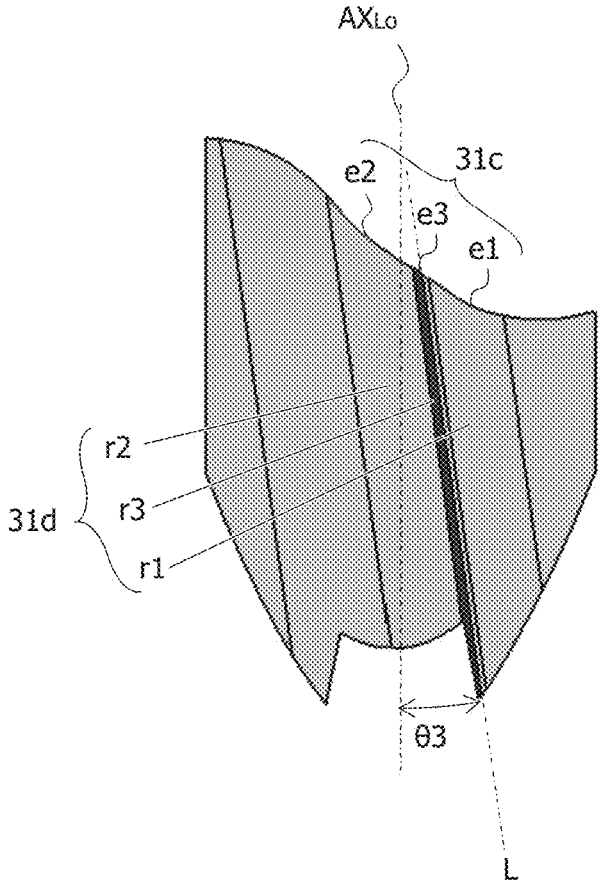
FIG. 5B is a top view of the edge section 31*c* and the reflection surface 31*d;*

FIG. 5A is a partial enlarged perspective view of the edge section 31*c* and the reflection surface 31*d*, and FIG. 5B is a top view of the edge section 31*c* and the reflection surface 31*d*.

As shown in FIGS. 5A and 5B, the edge section 31*c* is configured to have a shape corresponding to the cutoff line CL of the low-beam light distribution pattern $P_{Lo}$. The edge section 31*c* has a Z-shaped step, for example. Specifically, the edge section 31*c* includes: a first edge part e1 corresponding to the left cutoff line CL1; a second edge part e2 corresponding to the right cutoff line CL2; and a third edge part e3 corresponding to the oblique cutoff line CL3 connecting between the left cutoff line CL1 and the right cutoff line CL2.

The first edge part e1 corresponding to the left cutoff line CL1 is disposed at a position one level higher than the second edge part e2 corresponding to the right cutoff line CL2 with respect to the vertical direction (in the case of the right-hand traffic). The third edge part e3 is inclined at an angle of 45° with respect to the first edge part e1 (and the second edge part e2). Note that the third edge part e3 may be inclined at an angle of 15° with respect to the first edge part e1 (and the second edge part e2). Note that a horizontally-reversed edge section 31*c* is employed in the case of the left-hand traffic.

The reflection surface 31*d* is provided between the edge section 31*c* and a rear end (the first light-entering surface 31*a*) of the rear lens unit 31 (see FIG. 4), and internally reflects at least part of the light from the light source 40 that has entered the rear lens unit 31. Specifically, the reflection surface 31*d* includes: a first reflection surface r1 including the first edge part e1; a second reflection surface r2 including the second edge part e2; and a third reflection surface r3 including the third edge part e3 as shown in FIGS. 5A and 5B.

As shown in FIG. 5B, the third reflection surface r3 extends rearward from the third edge part e3 along a straight line L inclined at a predetermined angle θ3 with respect to a reference axis $AX_{Lo}$ extending in the vehicle longitudinal direction. That is, the third reflection surface r3 is an inclined surface inclined at the predetermined angle θ3 with respect to the reference axis $AX_{Lo}$.

Figure 6A:
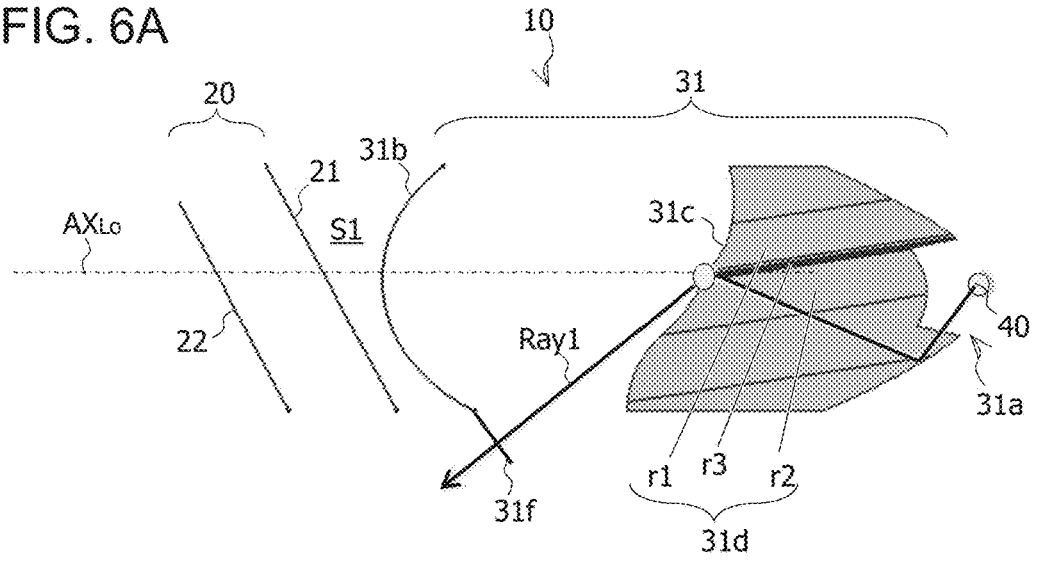
FIG. 6A is an example where a light-exiting surface 31*f* through which light Ray1 from a light source 40 that has been internally reflected by a third reflection surface r3 exits is provided in a rear lens unit 31.
Figure 6B:
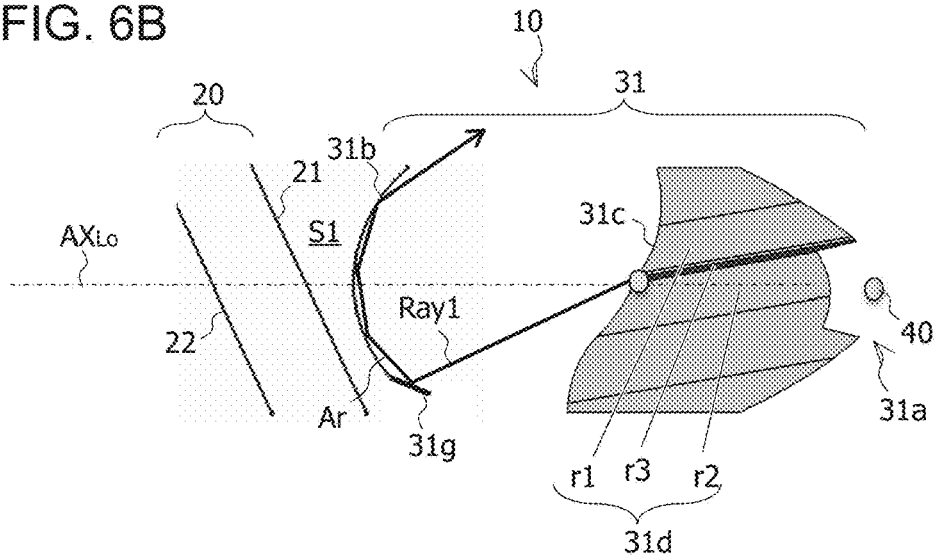
FIG. 6B is an example where an additional reflection surface 31*g* that internally reflects the light Ray1 from the light source 40 that has been internally reflected by the third reflection surface r3 is provided in the rear lens unit 31.
Figure 6C:
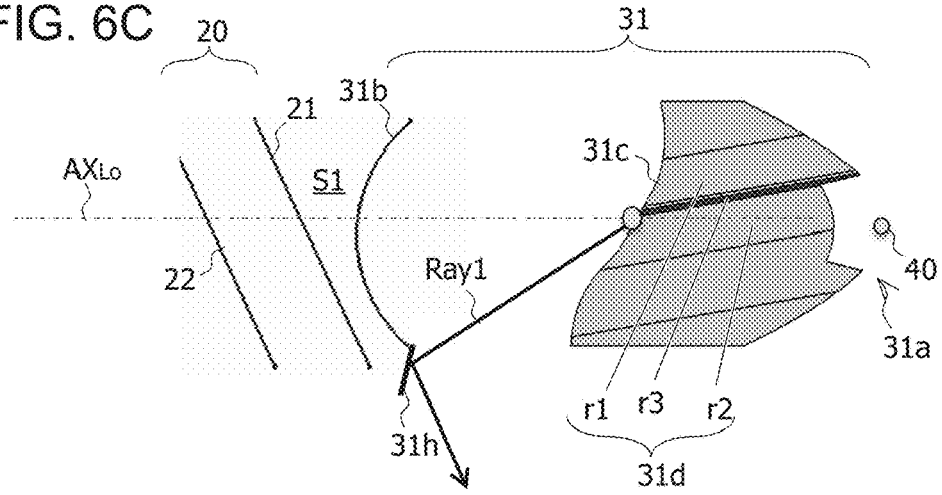
FIG. 6C is an example where a light-blocking part 31*h* that blocks the light Ray1 from the light source 40 that has been internally reflected by the third reflection surface r3 is provided in the rear lens unit 31.

Specifically, as shown in FIGS. 6A to 6C, the third reflection surface r3 is inclined at the predetermined angle θ3 with respect to the reference axis $AX_{Lo}$ so that light Ray1 from the light source 40 that has been internally reflected by the third reflection surface r3 (light to be a cause of the occurrence of glare in the vicinity of the oblique cutoff line in the conventional techniques) travels in a direction other than to the first light-exiting surface 31*b* of the rear lens unit 31 (i.e., the light Ray1 is prevented from being incident on the first light-exiting surface 31*b*). In other words, the third reflection surface r3 is inclined at the predetermined angle θ3 with respect to the reference axis $AX_{Lo}$ so that the light Ray1 from the light source 40 that has been internally reflected by the third reflection surface r3 travels in a direction other than to the low-beam light distribution pattern $P_{Lo}$.

Note that the third reflection surface r3 only needs to be inclined at the predetermined angle θ3 with respect to the reference axis $AX_{Lo}$ and the length of the third reflection surface r3 starting from the third edge part e3 (the length along the straight line L shown in FIG. 5B) is not limited to any particular length. For example, the length of the third reflection surface r3 (the length along the straight line L shown in FIG. 5B) may be a length ranging from the third edge part e3 to the rear end of the rear lens unit 31 (see FIG. 5B), or may be, while not shown in the figures, a length of about several millimeters (e.g., 5 mm) from the third edge part e3.

It is conceivable that the light Ray1 from the light source 40 that has been internally reflected by the third reflection surface r3 is caused to exit through a light-exiting surface 31*f* provided in the rear lens unit 31, for example, as shown in FIG. 6A. The light-exiting surface 31*f* is provided on an optical path of the light Ray1 from the light source 40 that has been internally reflected by the third reflection surface r3.

It is also conceivable that the light Ray1 from the light source 40 that has been internally reflected by the third reflection surface r3 is caused to be internally reflected by an additional reflection surface 31*g* provided in the rear lens unit 31 and the first light-exiting surface 31*b* of the rear lens unit 31 in this order, for example, as shown in FIG. 6B. The additional reflection surface 31*g* is provided on the optical path of the light Ray1 from the light source 40 that has been internally reflected by the third reflection surface r3. The additional reflection surface 31*g* is configured as a reflection surface that internally reflects the light Ray1 from the light source 40 that has been internally reflected by the third reflection surface r3 in a direction Ar (see FIG. 6B) such that the light Ray1 from the light source 40 that has been internally reflected by the third reflection surface r3 is internally reflected once or a plurality of times by the first light-exiting surface 31*b* of the rear lens unit 31 so as to travel in a direction other than to the first light-exiting surface 31*b*.

It is also conceivable that the light Ray1 from the light source 40 that has been internally reflected by the third reflection surface r3 is blocked by a light-blocking part 31*h* provided in the rear lens unit 31, for example, as shown in FIG. 6C. The light-blocking part 31*h* is provided on the optical path of the light Ray1 from the light source 40 that has been internally reflected by the third reflection surface r3. The light-blocking part 31*h* may be a reflection surface that internally reflects the light Ray1 from the light source 40 that has been internally reflected by the third reflection surface r3 in a direction other than to the first light-exiting surface 31*b* as shown in FIG. 6C, may be a diffusion surface (e.g., a surface with microasperities such as an embossed surface) that diffuses the light Ray1 from the light source 40 that has been internally reflected by the third reflection surface r3, or may be any other light-blocking surface.

Figure 7:
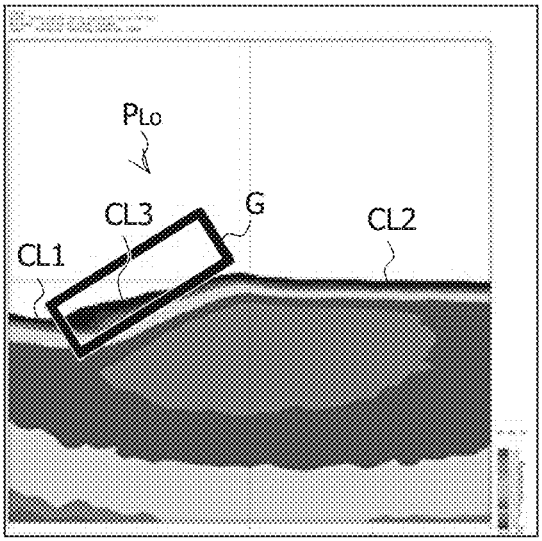
FIG. 7 is a partial enlarged view (simulation result) of the low-beam light distribution pattern PLo in the vicinity of the oblique cutoff line CL3.
Figure 8A:
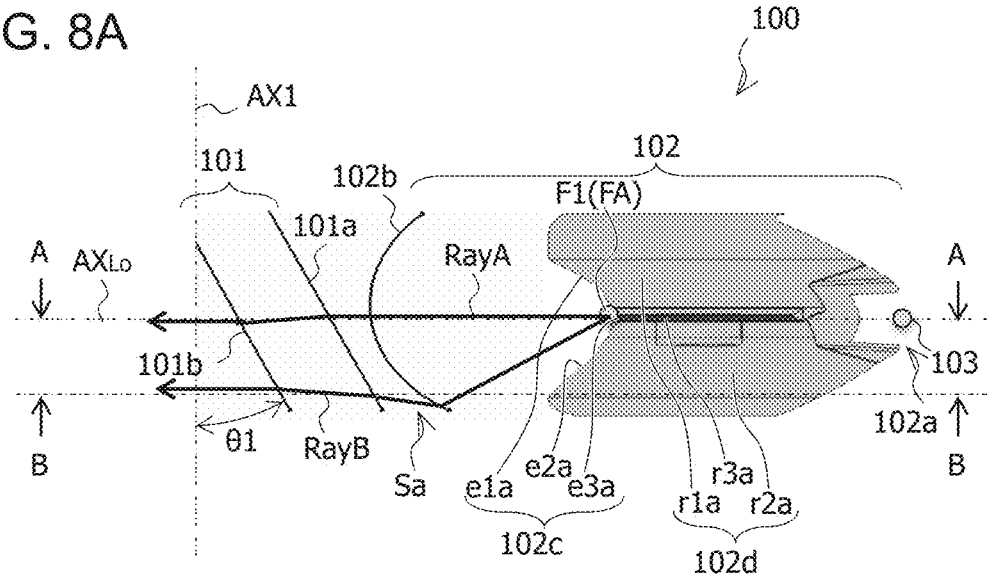
FIG. 8A is a top view showing a conventional vehicle lamp 100 (those other than major optical surfaces are omitted)
Figure 8B:
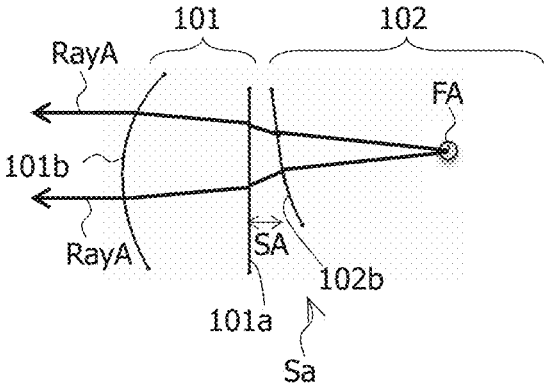
FIG. 8B is a cross-sectional view taken along line A-A in FIG. 8A (those other than the major optical surfaces are omitted)
Figure 8C:
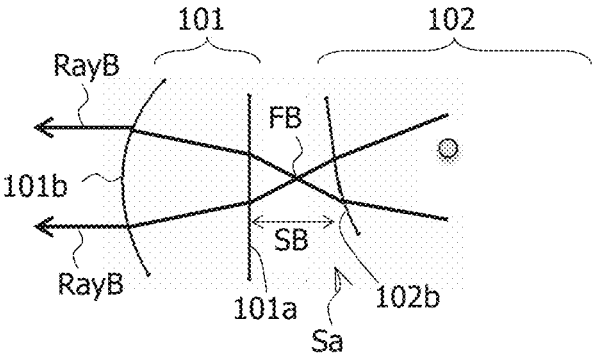
FIG. 8C is a cross-sectional view taken along line B-B in FIG. 8A (those other than the major optical surfaces are omitted)
Figure 9:
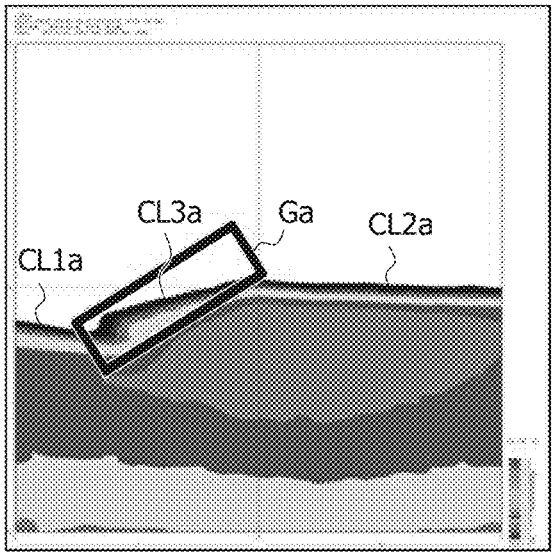
FIG. 9 is a partial enlarged view (simulation result) of the low-beam light distribution pattern formed by the vehicle lamp 100 in the vicinity of the oblique cutoff line CL3*a*.

As described above, the third reflection surface r3 is inclined with respect to the reference axis $AX_{Lo}$ and the light Ray1 from the light source 40 that has been internally reflected by the third reflection surface r3 travels in a direction other than to the first light-exiting surface 31*b* of the rear lens unit 31 (i.e., the light Ray1 is prevented from being incident on the first light-exiting surface 31*b*). Thus, the occurrence of glare can be reduced in the vicinity of the oblique cutoff line CL3 of the low-beam light distribution pattern $P_{Lo}$ as shown in FIG. 7. FIG. 7 is a partial enlarged view (simulation result) of the low-beam light distribution pattern $P_{Lo}$ in the vicinity of the oblique cutoff line CL3. Referring to an area surrounded by a square G shown in FIG. 7, a black-filled region (region having a relatively low luminous intensity) is increased as compared to the area surrounded by the square Ga shown in FIG. 9 (the conventional technique). It can be therefore recognized that the occurrence of glare has been reduced.

When the light source 40 is turned on in the vehicle lamp 10 with the above-described configuration, light from the light source 40 enters the rear lens unit 31 through the first light-entering surface 31*a*, and exits, after being partially blocked by the reflection surface 31*d*, through the first light-exiting surface 31*b* together with reflected light from the reflection surface 31*d* (the first reflection surface r1 and the second reflection surface r2). Then, the light from the light source 40 that exits through the first light-exiting surface 31*b* is condensed in the first direction due to the function of the first light-exiting surface 31*b*. The light from the light source 40 that has exited through the first light-exiting surface 31*b* then passes through a space S1 between the rear lens unit 31 and the front lens body 20, further enters the front lens body 20 through the second light-entering surface 21, and exits through the second light-exiting surface 22 to be irradiated forward. Then, the light from the light source 40 that exits through the second light-exiting surface 22 is condensed in the second direction due to the function of the second light-exiting surface 22. This forms the low-beam light distribution pattern $P_{Lo}$.

In other words, a luminous intensity distribution formed in the vicinity of the edge section 31*c* by the light from the light source 40 that has entered the rear lens unit 31 is projected forward in an inverted manner by the rear lens unit 31 (the first light-exiting surface 31*b*) and the front lens body 20 that function as the projection lens. This forms the low-beam light distribution pattern $P_{Lo}$. The low-beam light distribution pattern $P_{Lo}$ includes the cutoff line CL defined by the edge section 31*c* at the upper edge thereof.

As described above, in the formation of the low-beam light distribution pattern $P_{Lo}$, the light Ray1 from the light source 40 that has been internally reflected by the third reflection surface r3 travels in a direction other than to the first light-exiting surface 31*b* of the rear lens unit 31 as shown in FIG. 6A, and then exits through the light-exiting surface 31*f* provided in the rear lens unit 31. Alternatively, such light Ray1 is internally reflected by the additional reflection surface 31*g* provided in the rear lens unit 31 and the first light-exiting surface 31*b* of the rear lens unit 31 in this order as shown in FIG. 6B. Alternatively, such light Ray1 is blocked by the light-blocking part 31*h* provided in the rear lens unit 31 as shown in FIG. 6C.

As just described, the light Ray1 from the light source 40 that has been internally reflected by the third reflection surface r3 (the light to be a cause of the occurrence of glare in the vicinity of the oblique cutoff line in the conventional techniques) travels in a direction other than to the first light-exiting surface 31*b* of the rear lens unit 31, and therefore does not exit through the first light-exiting surface 31*b* of the rear lens unit 31. Thus, the occurrence of glare can be reduced in the vicinity of the oblique cutoff line CL3 of the low-beam light distribution pattern $P_{Lo}$.

As described above, this embodiment can provide the vehicle lamp 10 that can reduce the occurrence of glare in the vicinity of the oblique cutoff line CL3 of the low-beam light distribution pattern.

This is achieved by the third reflection surface r3 being inclined with respect to the reference axis $AX_{Lo}$ extending in the vehicle longitudinal direction.

That is, because of the third reflection surface r3 being inclined with respect to the reference axis $AX_{Lo}$ extending in the vehicle longitudinal direction, the light Ray1 from the light source 40 that has been internally reflected by the third reflection surface r3 (the light to be a cause of the occurrence of glare in the vicinity of the oblique cutoff line in the conventional techniques) travels in a direction other than to the first light-exiting surface 31*b* of the rear lens unit 31, and therefore does not exit through the first light-exiting surface 31*b*.

Modifications will be described next.

While the example in which the flat surface (e.g., the vertical surface) is employed as the second light-entering surface 21 of the front lens body 20 and the semi-cylindrical surface (cylindrical surface) with the cylindrical axis thereof extending in the first direction is employed as the second light-exiting surface 22 has been described in the above-described embodiment, the present invention is not limited thereto.

For example, a semi-cylindrical surface (cylindrical surface) with a cylindrical axis thereof extending in the first direction may be employed as the second light-entering surface 21 of the front lens body 20, and a flat surface (e.g., a vertical surface) may be employed as the second light-exiting surface 22.

While the example in which the semi-cylindrical surface (cylindrical surface) with the cylindrical axis thereof extending in the second direction is employed as the first light-exiting surface 31*b* of the rear lens unit 31 has been described in the above-described embodiment, the present invention is not limited thereto.

For example, a convex lens surface that is convex toward the front of the vehicle may be employed as the first light-exiting surface 31*b* of the rear lens unit 31.

The numerical values shown in the above-described embodiment are all given by way of example, and it is obvious that appropriate different numerical values can be used instead.

The above-described embodiment is, in every respect, merely an example. The present invention should not be limited by the description of the above-described embodiment. The present invention can be implemented in other various ways without departing from its spirit or major characteristics.

The invention claimed is:

1. A vehicle lamp comprising:

a front lens body;

a rear lens unit disposed behind the front lens body; and a light source that is disposed behind the rear lens unit and emits light to be irradiated forward after passing through the rear lens unit and the front lens body in this order so as to form a low-beam light distribution pattern, wherein the rear lens unit includes an edge section that defines a cutoff line of the low-beam light distribution pattern, and a reflection surface provided between the edge section and a rear end of the rear lens unit, the reflection surface internally reflects at least part of the light from the light source that has entered the rear lens unit, the edge section includes a first edge part corresponding to a left cutoff line, a second edge part corresponding to a right cutoff line, and a third edge part corresponding to an oblique cutoff line connecting between the left cutoff line and the right cutoff line, the reflection surface includes a first reflection surface including the first edge part, a second reflection surface including the second edge part, and a third reflection surface including the third edge part, and the third reflection surface is inclined with respect to a reference axis extending in a vehicle longitudinal direction.

2. The vehicle lamp according to claim 1, wherein the third reflection surface is inclined with respect to the reference axis so that light from the light source that has been internally reflected by the third reflection surface travels in a direction other than to a light-exiting surface of the rear lens unit.

3. The vehicle lamp according to claim 2, wherein the rear lens unit includes an additional light-exiting surface through which the light from the light source that has been internally reflected by the third reflection surface exits.

4. The vehicle lamp according to claim 2, wherein the rear lens unit includes an additional reflection surface that internally reflects the light from the light source that has been internally reflected by the third reflection surface, and the additional reflection surface is configured as a reflection surface that internally reflects the light from the light source that has been internally reflected by the third reflection surface in a direction such that the light from the light source that has been internally reflected by the third reflection surface is internally reflected once or a plurality of times by the light-exiting surface of the rear lens unit.

5. The vehicle lamp according to claim 2, wherein the rear lens unit includes a light-blocking part that blocks the light from the light source that has been internally reflected by the third reflection surface.

6. The vehicle lamp according to claim 1, wherein the third reflection surface is inclined with respect to the reference axis so that the light from the light source that has been internally reflected by the third reflection surface travels in a direction other than to the low-beam light distribution pattern.

7. The vehicle lamp according to claim 1, wherein the rear lens unit is a lens unit that condenses the light from the light source that passes through the rear lens unit in a first direction, the front lens body is a lens unit that condenses the light from the rear lens unit that passes through the front lens body in a second direction crossing the first direction, and at least one of a light-entering surface and a light-exiting surface of the front lens body is a cylindrical surface extending in the first direction.

8. The vehicular headlamp according to claim 1, wherein the shade is arranged between the first entry surface of the first lens unit and the first exit surface of the first lens unit.

9. The vehicular headlamp according to claim 1, wherein light from the light source entered the first lens unit is focused towards the shade.

* * * * *